US006463902B1

(12) United States Patent
Curtis et al.

(10) Patent No.: US 6,463,902 B1
(45) Date of Patent: Oct. 15, 2002

(54) AIR SUPPLY SYSTEM FOR A MARINE ENGINE

(75) Inventors: Mark D. Curtis, Hartford; Wade A. Loberger, Oshkosh; Ronald M. Holinka, Chilton, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/912,771

(22) Filed: Jul. 25, 2001

(51) Int. Cl.[7] ..... F02B 77/00
(52) U.S. Cl. ..... 123/184.21
(58) Field of Search ..... 123/198 E; 55/385.3, 55/481, 506, 467

(56) References Cited

U.S. PATENT DOCUMENTS

| | | | | |
|---|---|---|---|---|
| 4,767,425 A | | 8/1988 | Camplin et al. | 55/306 |
| 5,020,973 A | | 6/1991 | Lammers | 417/243 |
| 5,375,578 A | | 12/1994 | Kato et al. | 123/516 |
| 5,865,863 A | * | 2/1999 | DeSousa et al. | 123/198 E |
| 5,899,778 A | * | 5/1999 | Hiraoka et al. | 123/184.21 |
| 5,996,546 A | | 12/1999 | Kollmann et al. | 123/195 |
| 6,152,120 A | | 11/2000 | Julazedeh | 123/572 |

* cited by examiner

*Primary Examiner*—Gene Mancene
*Assistant Examiner*—Hyder Ali
(74) *Attorney, Agent, or Firm*—William D. Lanyi

(57) ABSTRACT

An air supply system for a marine engine includes an air duct, or sound attenuator cavity, that receives air through a plurality of inlets and directs air to an outlet of the air duct disposed over a throttle body of an air intake manifold. An air filter assembly is shaped to be attached to a wall of the air duct with a filter medium portion extending into the cavity of the air duct and an outlet port or nipple, extending out of the air duct. A compressor is connected in fluid communication with the outlet port of the air filter assembly through the use of a flexible tube, such as a rubber hose, in order to provide filtered air to the compressor. The air filter assembly is easily removed for inspection and/or replacement and is located with its filter medium within the protective housing of the air duct.

17 Claims, 6 Drawing Sheets

10

AIR SUPPLY SYSTEM FOR A MARINE ENGINE

BACKGROUND OF THE INVENTION

1. Field of the Invention

The present invention relates generally to an air supply system for a marine engine and, more particularly, to an air supply system in which an air duct, such as a sound attenuator, is shaped to receive an air filter assembly of an air compressor in such a way that the air duct protects the filter media and provides improved sound attenuation of air compressor sounds.

2. Description of the Prior Art

Internal combustion engines require a means for providing a stream of air flowing toward and into an air intake manifold of the engine. These air conduits can be a simple opening in an air intake manifold or can incorporate sound attenuating features and protective covers.

U.S. Pat. No. 5,996,546, which issued to Kollmann et al on Dec. 7, 1999, discloses an integrated flywheel cover and air conduit passages. A cover for an outboard motor is provided to protect an operator from a flywheel. The cover is disposed under the cowl of the outboard motor. The cover is made of a generally rigid material, such as plastic, with first and second sheets being associated together to form conduits with openings extending therefrom. In one particular embodiment, one of the openings is shaped to receive an inlet of a compressor and this provides a positioning aid in attaching the cover to the engine. This device eliminates the need for flexible hoses and accomplishes two tasks with one component. It provides air conduits for the air passing through the cover and it provides a generally rigid means for locating the proper location of the cover. U.S. Pat. No. 5,375,578, which issued to Kato et al on Dec. 27, 1994, describes a high pressure fuel feeding device for a fuel injection engine. A high pressure fuel/air injection system for an outboard motor has a V-cylinder arrangement wherein the major components of the air/fuel supply system are disposed in the valley between the cylinder banks. The system includes a vapor fuel separator that has a fuel chamber in which the supply of fuel is maintained by a float valve and an air chamber positioned above the fuel chamber and to one side of it and which communicates with the fuel chamber through a perforated member. A filter media fills the air chamber and an atmospheric air inlet is provided to the air chamber. Fuel pressure and fuel regulator valves are disposed in the area to the side of the air chamber and regulate fuel and air pressure by dumping fuel and air back to the fuel and air chambers, respectively, through integral internal conduits. The regulating system includes an arrangement for regulating the fuel pressure so that it will be at least greater than the air pressure by a predetermined amount and also for precluding the delivery of air under pressure if fuel under pressure is not supplied. The arrangement also incorporates a system for insuring that fuel cannot flow out of the atmospheric air inlet if the outboard motor is tilted up or is laid on its sides. An additional air supply is provided for the air compressor in the event that the air chamber becomes clogged or inadequate to supply the air requirements for the system.

U.S. Pat. No. 4,767,425, which issued to Camplin et al on Aug. 30, 1988, describes an aspirator mechanism for turbine engine air cleaner. A known military tank is powered by a turbine engine having a large capacity air filter unit; a fan is ordinarily employed to draw dust-laded air from the filter unit. Erosion of the fan blades by fast moving dust particles is a problem. The invention substitutes for the fan an aspirator mechanism; fast moving combustion products flowing through the engine exhaust duct draw-dust laden air from the filter unit through a slot like orifice in one wall of the duct.

U.S. Pat. No. 5,020,973, which issued to Lammers on Jun. 4, 1991, describes an air compressor shroud. A V-twin, two stage compressor has valve plates disposed between the head and cylinder of each stage and mounting free floating flexible reed intake and exhaust valves therein. The flexible reeds are movably captured between the floors of respective reed recesses, and separate, non-fixed keeper bars are disposed over, but slightly spaced from the reeds. Keeper bars over the exhaust reed extend above the valve plate for engagement by the head. A restrictor plate lies within a valve plate recess on keeper bars over the intake valve. A cored crankshaft provides motor drive shaft lubrication. A removable counterweight provides a crankshaft with one-piece connecting rods. A cooling fan is driven by the removable counterweight and V-shaped fan shroud projections direct cooling air over the cylinders and heads while another cooling air port directs air over an intercooler. An intake manifold having a plurality of intake tubes and rib and wall structure for an air filter which divides the chamber. The air filter both filters air and muffles compressor noise.

U.S. Pat. 6,152,120, which issued to Julazadeh on Nov. 28, 2000, describes a diesel engine system with oil-air separator and a method of operation. A separator receives crankcase fumes having blowby gas and oil mist. A rotatable filter in the separator passes the gas constituents to an outlet for recycling back to an engine air intake. The filter, by rotating, causes oil to be flung centrifugally out onto a wall from which it can be drained from the separator and returned to the crankcase.

The patents described above are hereby expressly incorporated by reference in the description of the present invention.

Compressors generate noise as they draw air into their working chambers. This movement of air into the compressor often generates a cyclic sound level that corresponds to the pulsations caused by the intermittent passage of air into the compressor. Compressors often require that a filter be provided to prevent debris from entering the working chambers of the compressor. The sound generated by the compressor is typically evident at the filter media of the compressor. It would therefore be significantly beneficial if an air supply system of a marine engine could be provided with a structure that attenuates the sound emanating from the air filter of a compressor while also protecting the filter media of the air filter from direct exposure to the oil, fuel, and dust-laden air immediately surrounding the internal combustion engine. It would also be significantly beneficial if an air filter of this type could be attached to an air duct in a manner that allows easy removal, examination, and replacement of the filter.

SUMMARY OF THE INVENTION

An air supply system for a marine engine made in accordance with the present invention comprises an air duct having at least one inlet opening and an outlet opening disposed in fluid communication with the inlet of an air intake manifold of the marine engine, wherein the air duct is attachable to the marine engine for support. The air supply system of the present invention further comprises an air filter assembly having an outlet port and a filter medium though which air can be drawn into the air filter assembly from within the air duct and conducting toward the outlet port. The air filter assembly is removably attached to the air duct with the filter medium being disposed within a cavity of the air duct and the outlet port being disposed outside of the air duct. The air filter assembly is removable from the air duct while the air duct remains attached to the marine engine.

The present invention further comprises a compressor having an air inlet connected in fluid communication with the outlet port of the air filter assembly. A flexible tube is connected between the outlet port and the compressor. In a typical application of the present invention, the air duct is a sound attenuator which is disposed at a foreward side of the marine engine.

In a particularly preferred embodiment of the present invention, the air filter assembly comprises a cover portion. The internal conduit of the outlet port extends through the cover portion. The outlet port and the filter medium extend from the cover portion in opposite directions. The cover portion is attachable to the air duct by inserting the filter medium through a hole in the air duct and subsequently rotating the air filter assembly about a central axis which extends through the outlet port, the filter medium, and the cover portion. The filter medium comprises a plurality of exposed folds of a selectively pervious material. The filter medium is exposed to air passing through the air duct. The air duct is disposed over a throttle body of the marine engine and along a foreward side of the marine engine. The marine engine is an internal combustion engine of an outboard motor.

BRIEF DESCRIPTION OF THE DRAWINGS

The present invention will be more fully and completely understood from a reading of the description of the preferred embodiment of the present invention, in conjunction with the drawings, in which.

DESCRIPTION OF THE PREFERRED EMBODIMENT

Figure 1:
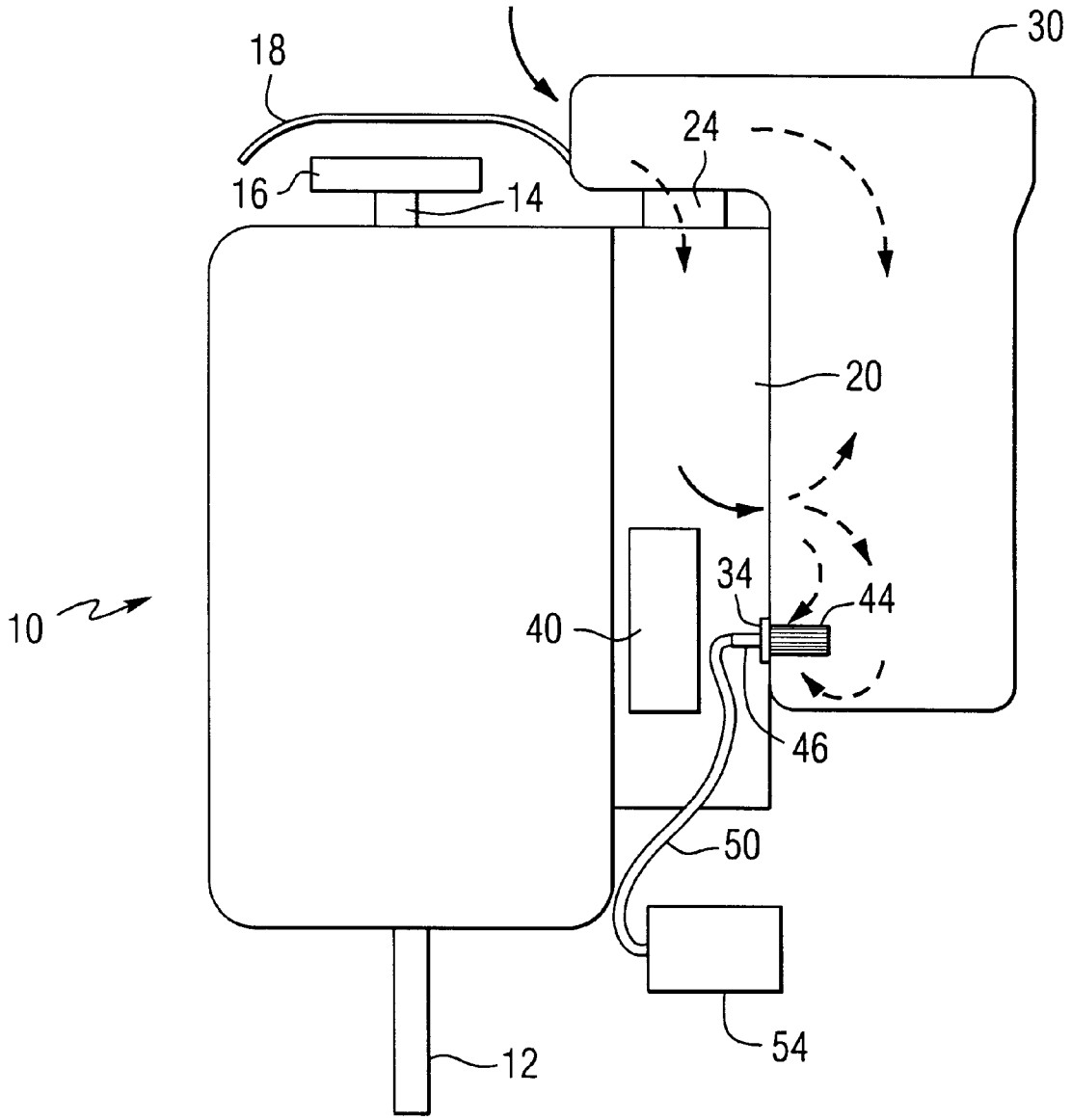
FIG. 1 is a highly schematic side view of a hypothetical engine with an air duct associated with an air filter assembly.

Throughout the description of the preferred embodiment of the present invention, like components will be identified by like reference numerals.

FIG. 1 is a highly simplified schematic illustration showing various components of an outboard motor for the purpose of describing the relative positions of those components. In FIG. 1, a marine engine 10 is shown with a drive shaft 12 disposed for rotation about a vertical center line. Above the engine 10, an extension 14 of the engine's crankshaft is attached to a flywheel 16. In certain applications of marine engines, a protective flywheel cover 18 is disposed around and above the flywheel 16. An air intake manifold structure 20 is a portion of the engine 10 that directs a stream of air toward and into the combustion chambers of the engine 10. A throttle body structure 24 conducts air into the air intake manifold structure 20.

With continued reference to FIG. 1, an air duct 30 serves several purposes in marine engine applications. Primarily, it conducts air to preselected locations for use by the engine 10. Also, it serves as a sound attenuator that reduces the noise level emanating from the engine. The solid line arrows in FIG. 1 represent the passage of air in the region surrounding the engine 10 prior to the air flowing into the air duct 30. The dashed line arrows in FIG. 1 represent the passage of air within the cavity of the air duct. As can be seen, the dashed line arrows indicate that air flows from within the air duct 30 into the throttle body 24. It also flows toward an air filter assembly 34 which will be described in greater detailed below. Reference numeral 40 identifies the position of a starter motor used in conjunction with the engine 10.

Air flows from within the cavity of the air duct 30 toward and through a filter medium 44. Air flowing through the filter medium 44 then proceeds through an outlet port 46 of the air filter assembly. From there, the filtered air is directed through a flexible tube 50 to an air compressor 54. The air compressor pressurizes the air and directs it to the engine 10. The connection between the air compressor 54 and the engine 10 is not directly related to the present invention and will not be described in detail herein.

With continued reference to FIG. 1, it can be seen that a portion of the air duct 30 extends above a portion of the engine 10 to facilitate the connection between an outlet of the air duct 30 and the inlet of the air intake manifold 20, which is illustrated as a throttle body 24 in FIG. 1. A portion of the air duct 30 is also shown at a position proximate the foreward side of the engine 10. In this way, the air duct can serve as a sound attenuator which reduces the noise level in a marine vessel with which the marine vessel 10 is used.

Figure 2:
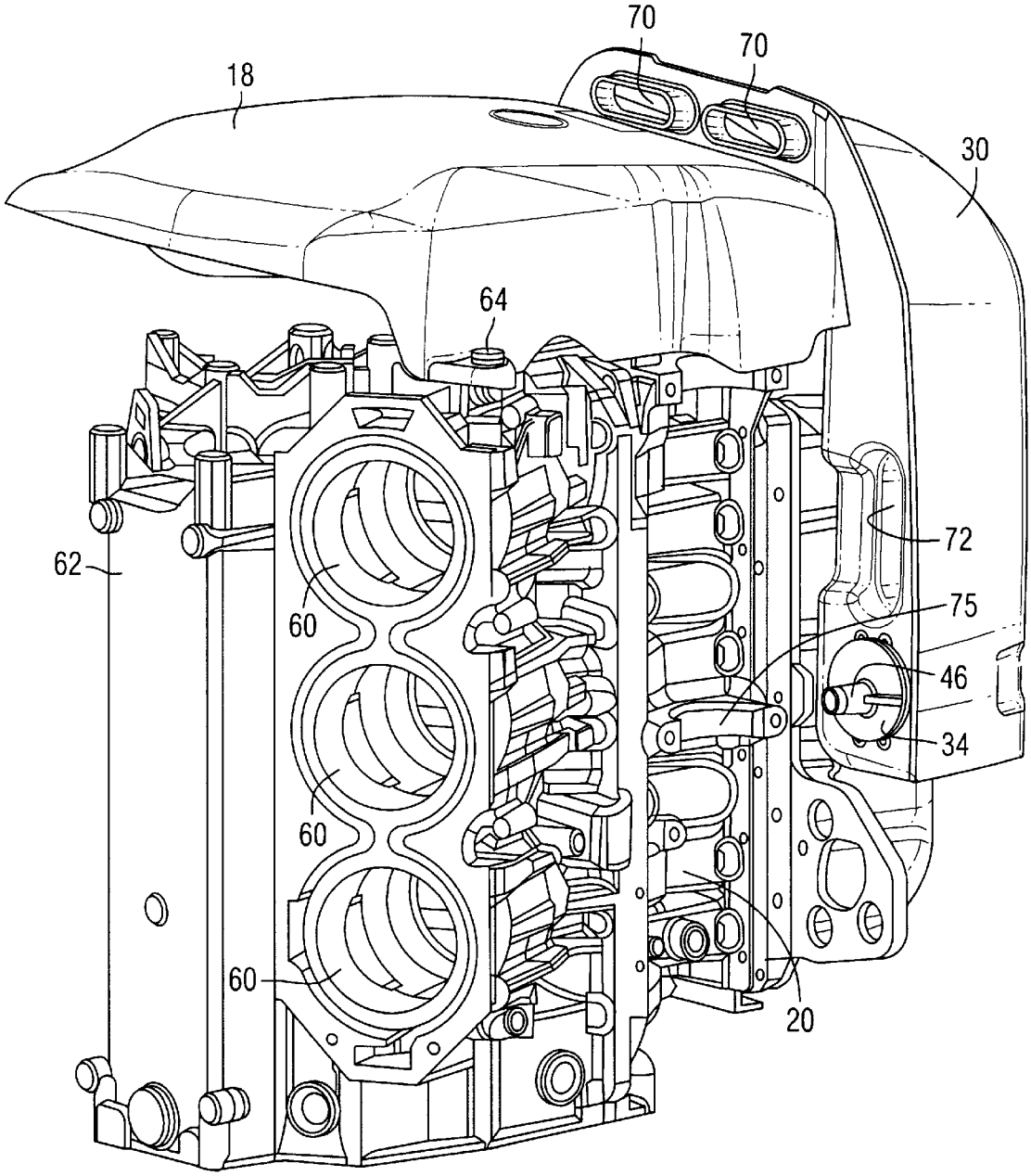
FIG. 2 is an isometric view of an engine with a flywheel cover, an air duct, and an air filter assembly.

FIG. 2 is an isometric view of the engine 10, with the head removed. Shown in FIG. 2 are three of six cylinders 60, an exhaust manifold structure 62, and the air intake manifold 20. A flywheel cover 18 is disposed above the engine 10 and attached to the engine at several locations, such as the location where bolt 64 is identified in FIG. 2. The air duct 30 need not be rigidly attached to the flywheel cover 18, but is typically disposed in close proximity with the flywheel cover 18 and in contact with it in one embodiment. Two inlet openings 70 are shown in the upper portion of the air duct 30 along with another inlet opening 72 at a lower portion.

With continued reference to FIG. 2, the air filter assembly is attached to the air duct 30, with the cover portion 34 fastened to a wall of the air duct 30 and the outlet port 46 extending away from the air duct 30. The filter medium of the air filter assembly is not visible in FIG. 2. The air duct 30, which serves as a sound attenuator, is disposed at a forward side of the engine 10 and between certain sound producing portions of the engine 10 and a marine vessel with which the marine engine 10 is used. A support bracket 75 for the starter motor 40 is also shown.

Figure 3:
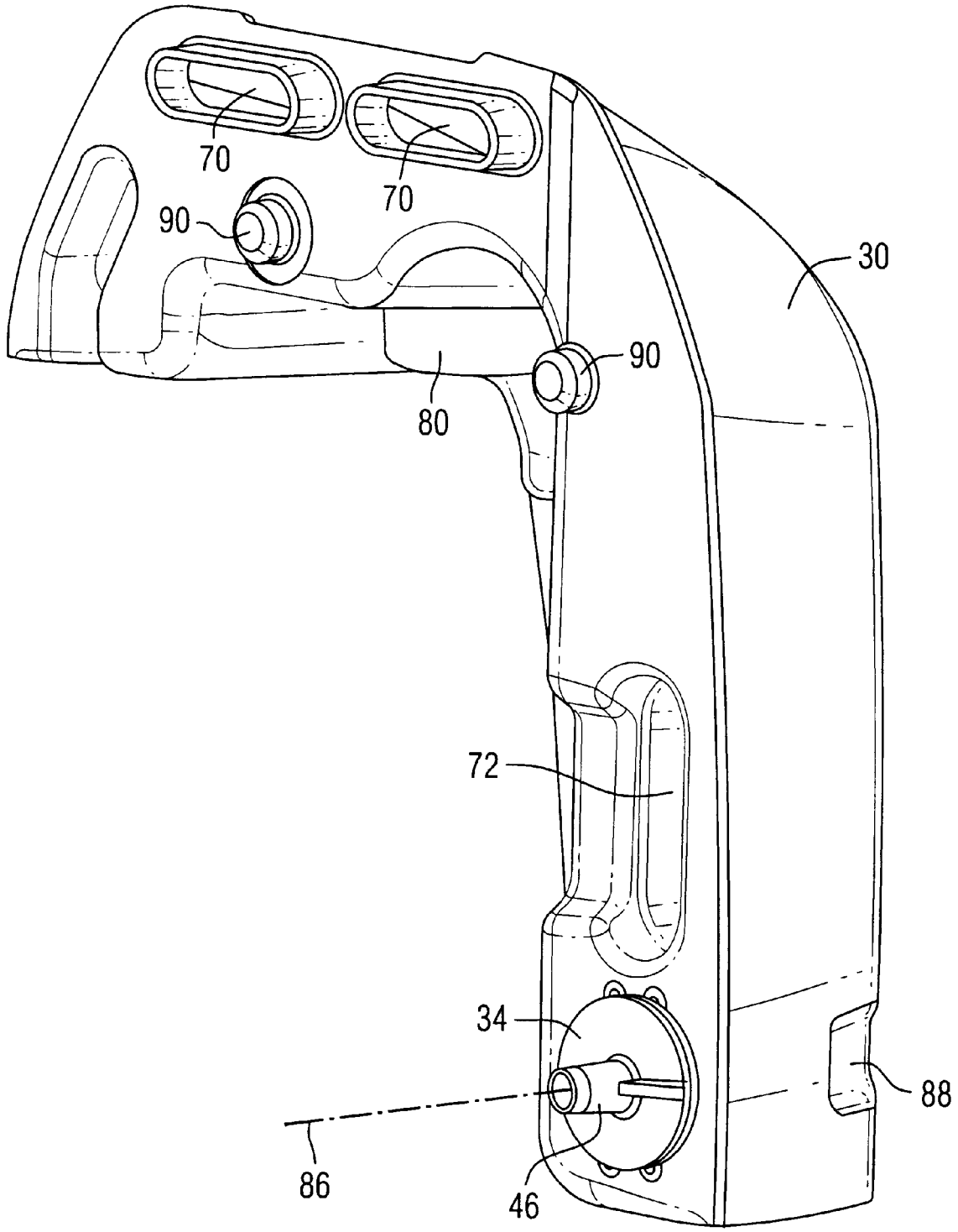
FIG. 3 is an isometric view of the air duct and air filter assembly attached together.

FIG. 3 is an isometric view of the air duct 30 with the inlet openings, 70 and 72, and an outlet opening 80 which is shaped to be received by the throttle body 24 described above in conjunction with FIG. 1. Air can flow into the cavity of the air duct 30 through the inlet openings, 70 and 72, and out of the cavity of the air duct 30 through the outlet opening 80. As described above in conjunction with FIG. 1, air can also flow out through the outlet port 46 of the air filter assembly. Axis 86 is an exemplary a line along which the air filter assembly can be removed from its attachment to the air duct 30. By rotating the cover portion 34, the air filter assembly can be manually moved away from the air duct 30 along axis 86. This easy removal from the air duct 30 allows the air filter assembly to be inspected or replaced easily. As will be described in greater detail below, a recessed portion 88 of the air duct 30 is provided so that a support hole for the air filter assembly can be formed as a part of the molded air duct 30 to more firmly support the air filter assembly when it is attached to the air duct. Reference numeral 90 is used to identify two protrusions formed in the air duct 30 to assist in aligning the air duct 30 with the flywheel cover 18.

Figure 4:
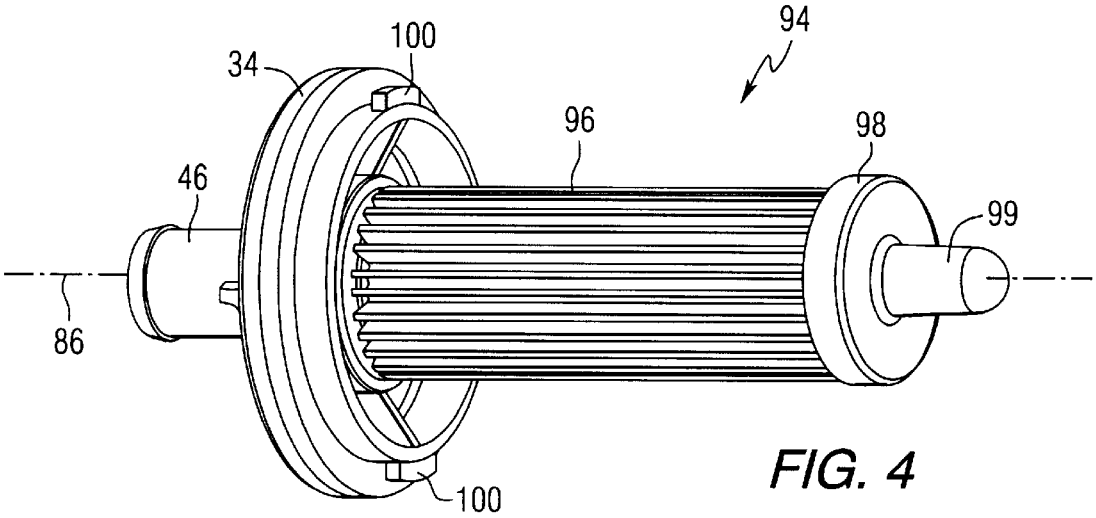
FIG. 4 is an isometric view of an air filter assembly.

FIG. 4 is an isometric view of the air filter assembly 94 which comprises the outlet port 46 and the filter medium 96. The filter medium 96 is disposed between the cover portion 34 and an end cap 98 which has an extension 99 formed on it. The cover portion 34, as illustrated in FIG. 4, has two tabs 100 formed in it and shaped to be received in corresponding slots of the air duct 30. By inserting the filter medium 96 into a hole of the air duct 30, aligned with axis 86, the filter medium 96 is inserted into the cavity of the air duct 30 and the tabs 100 are initially aligned with their corresponding slots. Then, the cover portion 34 is rotated to lock the air filter assembly 94 into position within the air duct 30. Prior to rotating the cover portion 34 to lock it into position, the extension 99 is aligned with a hole 110 formed in a portion of the air duct 30 to maintain the alignment of the air filter assembly 94 along axis 86.

Figure 5:
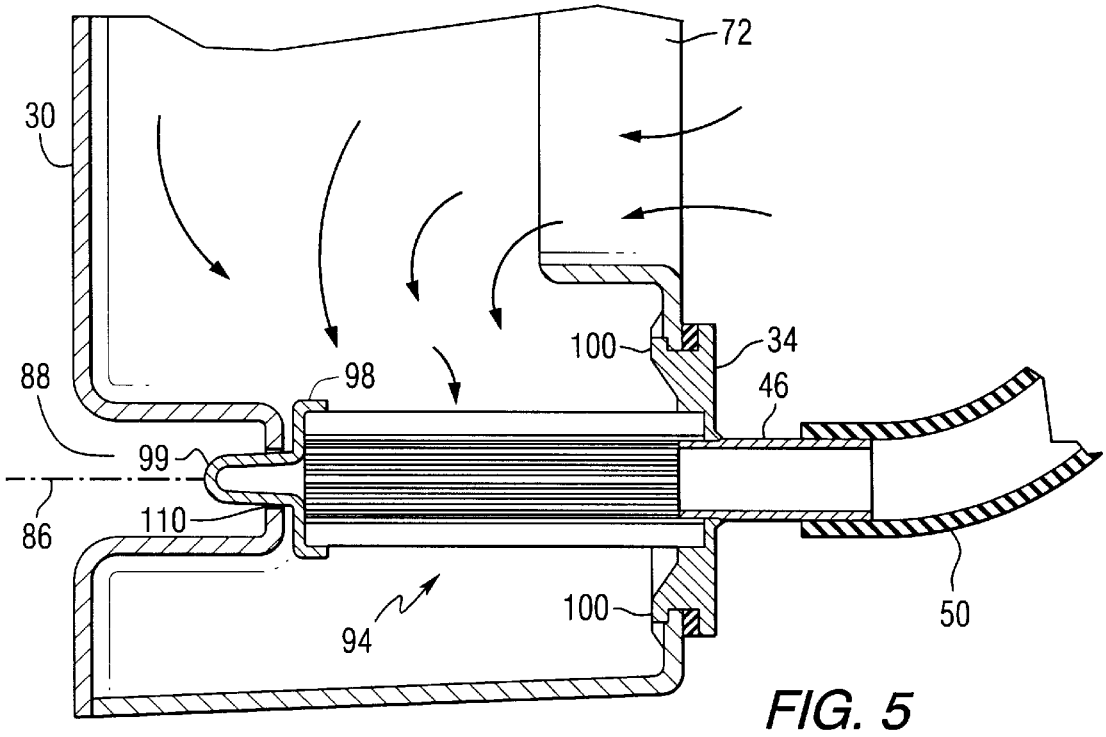
FIG. 5 is a side section view of an air filter assembly attached to an air duct.

FIG. 5 is a section view showing the air filter assembly 94 attached to the air duct 30. The air filter assembly 94 is aligned along axis 86 with the cover portion 34 locked into position as a result of the tabs 100 being in a position to capture the thickness of the air duct wall between the tabs 100 and the outer region of the cover portion 34. The opposite end of the air filter assembly 94 is held in place by the association of the extension 99 of the end cap 98 and the hole 110 formed in a portion of the wall of the air duct 30 within depression 88. The combination of the extension 99 in hole 110 and the cover portion 34 attached to an opposite wall of the air duct 30 holds the air filter assembly 94 firmly in place and minimizes vibration. The outlet port 46 is shown with a flexible tube 50, or hose, attached to it to enable the air filter assembly 94 to be connected in fluid communication with an air inlet of a compressor as described above in conjunction with FIG. 1. The arrows in FIG. 5 show the path of air traveling through the cavity of the air duct 30 from the various inlet opening 70 and 72 toward the air filter assembly 94.

With reference to FIGS. 4 and 5, it can be seen that the filter medium 96 comprises a plurality of exposed folds of a selectively pervious material, such as filter paper, and that the filter medium 96 is exposed to air passing through the air duct 30. When the air passes radially through the exposed folds of the filter medium 96, it is then conducted in a direction parallel to axis 86 and through the outlet port 46 of the air filter assembly. From there, the filtered air passes through the flexible tube 50 to the air compressor 54.

Figure 6:
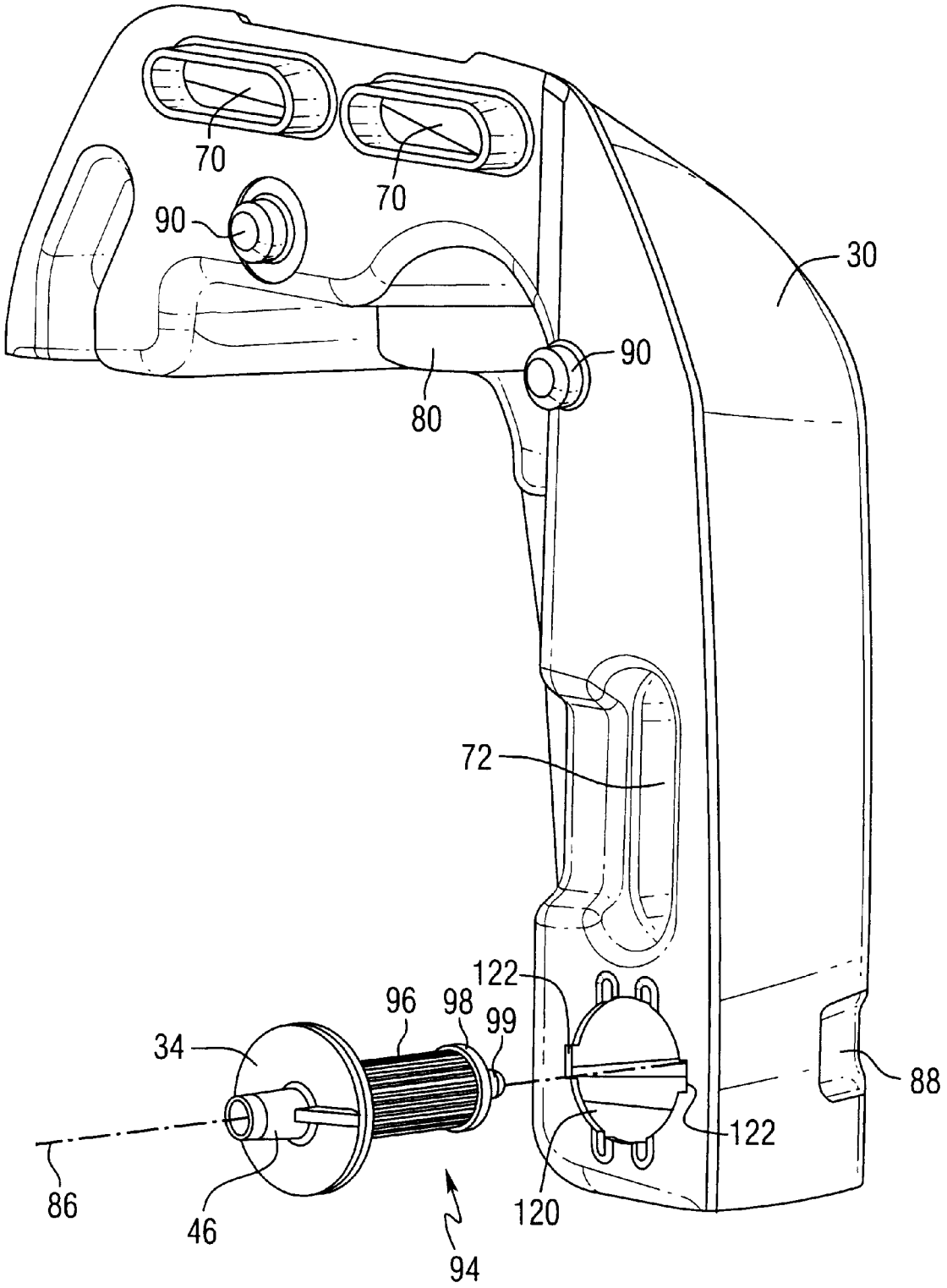
FIGS. 6 and 7 are exploded isometric views of an air duct and an air filter assembly.
Figure 7:
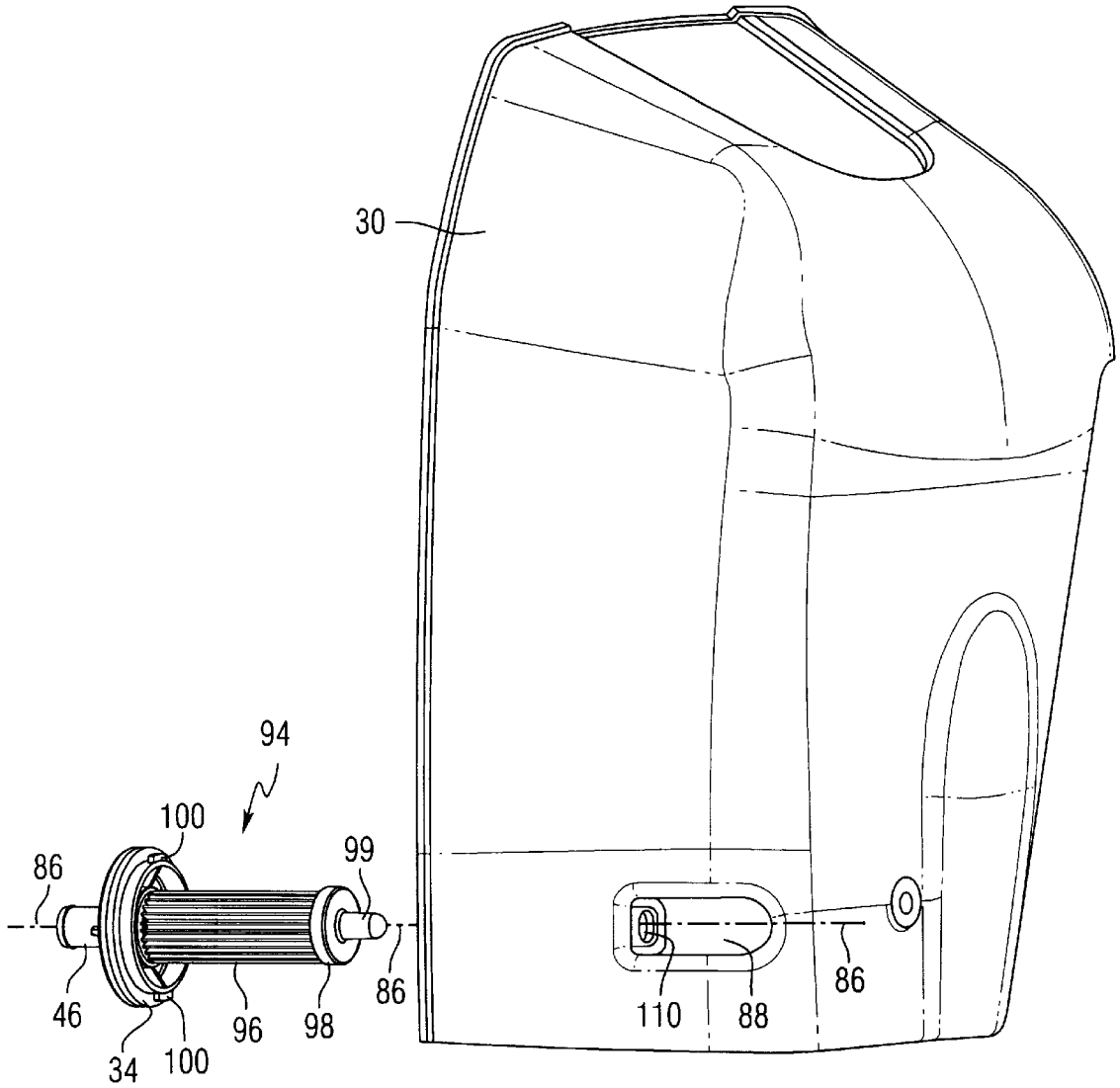

FIGS. 6 and 7 are exploded isometric views showing the relationship between the air duct 30 and the air filter assembly 94. A hole 120 is formed in a wall of the air duct 30 and shaped to receive the air filter assembly 94. Slots 122 are shaped to receive the tabs 100 and, in response to a rotation of the cover portion 34 about axis 86, the slots 122 are shaped to allow the tabs 100 to rotate away from the slots to firmly hold the cover portion 34 in place. The extension 94 is shaped to be received in hole 100 that is formed in a wall which results from the formation of the depression 88 in the air duct 30.

To insert the air filter assembly 94 in hole 120 and lock it in place, the air filter assembly is moved along axis 86 to place the filter medium 96 through hole 120 and into the cavity within the air duct 30. The extension 99 is aligned with opening 100 to hold the distal end of the air filter assembly 94 firmly in place. Rotation of the cover portion 34 then locks the air filter assembly in place through the cooperation of tabs 100 and slots 122.

The air supply system of the present invention provides significant benefits in comparison to air supply systems for marine engines known in the prior art. For example, the filter medium 96 is contained completely within the cavity of the air duct 30. This protects the filter medium 96 from direct exposure to oil, fuel, dust, and debris that are more prevalent in the vicinity of the outboard motor than within the cavity of the air duct 30. The location and position of the air filter assembly 94 allows for easy service by the operator of a marine vessel. The air filter assembly 94 can be easily removed along axis 86 without the necessity of additional tooling. The air filter assembly 94 can be pulled out of the hole 120 to expose its selectively pervious folds for the purpose of examination and inspection. If necessary, the air filter assembly 94 can be replaced by a new air filter assembly and attached to the air duct 30 by simply inserting the filter medium 96 into hole 120 until extension 96 aligns with and enters opening 100. Then the cover portion 34 is rotated by hand to lock the filter in position. Only one connection is necessary between the outlet port 46 and the flexible tube 50 described above in conjunction with FIG. 5.

With reference to FIGS. 1–7, the air duct 30 is provided with at least one inlet opening, 70 and 72, and an outlet opening 80 which is disposed in fluid communication with a throttle body 24 of an air intake manifold 20. The air duct 30 is attachable to the marine engine 10. The air filter assembly 94 has an outlet port 46 and a filter medium 96 through which air can be drawn into the air filter assembly from within the cavity of the air duct 30 and conducted toward the outlet port 46. The air filter assembly 94 is removably attached to the air duct 30 with the filter medium 96 being disposed within the cavity of the air duct and with the outlet port 46 being disposed outside of the air duct. The air filter assembly 94 is removably, along axis 86, from the air duct 30 when the air duct remains attached to the marine engine 10. In other words, there is no need to dismantle the air duct 30 from the engine 10 or from the flywheel cover 18 for the purpose of allowing the air filter assembly 94 to be removed, inspected, and/or replaced. This can all be done by hand without the need for additional tooling and without the need for dismantling any other components from the engine.

The air supply system can also comprise a compressor 54 which has an air inlet connected in fluid communication with the outlet port 46 of the air filter assembly 94. A flexible tube 50 is connected between the outlet port 46 and the compressor 54. In certain preferred embodiments of the present invention, the air duct 30 is actually a sound attenuator used to reduce the noise emanating from the engine. The sound attenuator is typically disposed at a forward side of the engine 10.

The air filter assembly 94 comprises a cover portion 34, with the outlet port 46 extending through the cover portion 34. The outlet port 46 and the filter medium 96 extend from the cover portion 34 in opposite directions. The cover portion 34 is attachable to the air duct 30 by inserting the filter medium 96 through a hole 120 in the air duct 30 and subsequently rotating the air filter assembly 94 about a central axis 86 which extends through the outlet port 46, the filter medium 96, and the cover portion 34. The filter medium 96, in a particularly preferred embodiment of the present invention, comprises a plurality of exposed folds of a selectively pervious material, with a filter medium 96 being exposed to air passing through the cavity of the air duct 30. The air duct 30 is disposed over a throttle body 24 of the marine engine 10 and along a foreward side of the marine engine. The marine engine can be an internal combustion engine of an outboard motor.

Although the present invention has been described in particular detail and specifically illustrated to show a preferred embodiment, it should be understood that alternative embodiments are also within its scope.

We claim:

1. An air supply system for a marine engine, comprising:

an air duct having at least one inlet opening and an outlet opening disposed in fluid communication with an inlet manifold of said marine engine, said air duct being attachable to said marine engine;

an air filter assembly having an outlet port and a filter medium through which air can be drawn into said air filter assembly from within said air duct and conducted toward said outlet port, said air filter assembly being removably attached to said air duct with said filter medium being disposed within said air duct and said outlet port being disposed outside of said air duct, said air filter assembly being removable from said air duct when said air duct remains attached to said marine engine; and a compressor having an air inlet connected in fluid communication with said outlet port of said air filter assembly.

2. The air supply system of claim 1, wherein:

a flexible tube connected between said outlet port and said compressor.

3. The air supply system of claim 1, wherein:

said air duct is a sound attenuator disposed at a foreward side of said marine engine.

4. The air supply system of claim 1, wherein:

said air filter assembly comprises a cover portion, said outlet port extending through said cover portion, said outlet port and said filter medium extending from said cover portion in opposite directions.

5. The air supply system of claim 4, wherein:

said cover portion is attachable to said air duct by inserting said filter medium through a hole in said air duct and subsequently rotating said air filter assembly about a central axis which extends through said outlet port, said filter medium, and said cover portion.

6. The air supply system of claim 1, wherein:

said filter medium comprises a plurality of exposed folds of a selectively pervious material, said filter medium being exposed to air passing through said air duct.

7. The air supply system of claim 1, wherein:

said air duct is disposed over a throttle body of said marine engine and along a foreward side of said marine engine.

8. The air supply system of claim 1, wherein:

said marine engine is an internal combustion engine of an outboard motor.

9. An air supply system for a marine engine, comprising:

an air duct having at least one inlet opening and an outlet opening disposed in fluid communication with an inlet manifold of said marine engine, said air duct being attachable to said marine engine, said air duct being a sound attenuator disposed at a side of said marine engine;

an air filter assembly having an outlet port and a filter medium through which air can be drawn into said air filter assembly from within said air duct and conducted toward said outlet port, said air filter assembly being removably attached to said air duct with said filter medium being disposed within said air duct and said outlet port being disposed outside of said air duct, said air filter assembly being removable from said air duct when said air duct remains attached to said marine engine, said air filter assembly comprising a cover portion, said outlet port extending through said cover portion, said outlet port and said filter medium extending from said cover portion in opposite directions; and a compressor having an air inlet connected in fluid communication with said outlet port of said air filter assembly.

10. The air supply system of claim 9, wherein:

a flexible tube connected between said outlet port and said compressor.

11. The air supply system of claim 10, wherein:

said cover portion is attachable to said air duct by inserting said filter medium through a hole in said air duct and subsequently rotating said air filter assembly about a central axis which extends through said outlet port, said filter medium, and said cover portion..

12. The air supply system of claim 11, wherein:

said filter medium comprises a plurality of exposed folds of a selectively pervious material, said filter medium being exposed to air passing through said air duct.

13. The air supply system of claim 12, wherein:

said air duct is disposed over a throttle body of said marine engine and along a foreward side of said marine engine.

14. An air supply system for a marine engine, comprising:

an air duct having at least one inlet opening and an outlet opening disposed in fluid communication with an inlet manifold of said marine engine, said air duct being attachable to said marine engine, said air duct being a sound attenuator disposed at a side of said marine engine;

an air filter assembly having an outlet port and a filter medium through which air can be drawn into said air filter assembly from within said air duct and conducted toward said outlet port, said air filter assembly being removably attached to said air duct with said filter medium being disposed within said air duct and said outlet port being disposed outside of said air duct, said air filter assembly being removable from said air duct when said air duct remains attached to said marine engine, said air filter assembly comprising a cover portion, said outlet port extending through said cover portion, said outlet port and said filter medium extending from said cover portion in opposite directions; and a compressor having an air inlet connected in fluid communication with said outlet port of said air filter assembly.

15. The air supply system of claim 14, wherein:

said cover portion is attachable to said air duct by inserting said filter medium through a hole in said air duct and subsequently rotating said air filter assembly about a central axis which extends through said outlet port, said filter medium, and said cover portion.

16. The air supply system of claim 15, wherein:

said filter medium comprises a plurality of exposed folds of a selectively pervious material, said filter medium being exposed to air passing through said air duct.

17. The air supply system of claim 16, wherein:

said air duct is disposed over a throttle body of said marine engine and along a foreward side of said marine engine.

* * * * *